US010313783B2

(12) United States Patent
Nardin et al.

(10) Patent No.: US 10,313,783 B2
(45) Date of Patent: Jun. 4, 2019

(54) LOUDSPEAKER ENCLOSURE WITH AT LEAST ONE LOUDSPEAKER WITH A CONVEX MOBILE MEMBRANE EXHIBITING CONTINUITY OF SHAPE WITH AN ADJACENT MEMBER

(71) Applicant: DEVIALET, Paris (FR)

(72) Inventors: Emmanuel Nardin, Vanves (FR); Pierre-Emmanuel Calmel, Le Chesnay (FR); Jean-Loup Afresne, Paris (FR); Julien Laurent Bergere, Versailles (FR); Antoine Petroff, Paris (FR)

(73) Assignee: Devialet, Paris (FR)

( * ) Notice: Subject to any disclaimer, the term of this patent is extended or adjusted under 35 U.S.C. 154(b) by 316 days.

(21) Appl. No.: 15/033,490

(22) PCT Filed: Oct. 13, 2014

(86) PCT No.: PCT/EP2014/071842
§ 371 (c)(1),
(2) Date: Jul. 29, 2016

(87) PCT Pub. No.: WO2015/062852
PCT Pub. Date: May 7, 2015

(65) Prior Publication Data

US 2016/0360311 A1 Dec. 8, 2016

(30) Foreign Application Priority Data

Oct. 30, 2013 (FR) ..... 13 60616

(51) Int. Cl.
*H04R 1/00* (2006.01)
*H04R 1/24* (2006.01)
(Continued)

(52) U.S. Cl.
CPC ..... *H04R 1/24* (2013.01); *H04R 1/2896* (2013.01); *H04R 5/02* (2013.01); *H04R 7/127* (2013.01); *H04R 2201/028* (2013.01)

(58) Field of Classification Search
CPC ..... H04R 1/2896; H04R 7/127
See application file for complete search history.

(56) References Cited

U.S. PATENT DOCUMENTS 3,925,626 A * 12/1975 Stallings, Jr. ..... H04R 1/021 181/153
4,295,006 A * 10/1981 Tanaka ..... H04R 1/24 381/99
2007/0009133 A1* 1/2007 Gerkinsmeyer ..... H04R 7/127 381/398

FOREIGN PATENT DOCUMENTS

EP 926923 A2 6/1999
EP 1162864 A2 12/2001
(Continued)

OTHER PUBLICATIONS

International Search Report for PCT/EP2014/071842 dated Jan. 14, 2015.
(Continued)

*Primary Examiner* — Matthew A Eason
(74) *Attorney, Agent, or Firm* — Thompson Coburn LLP; Steven M. Ritchey

(57) ABSTRACT

Loudspeaker enclosure comprising at least one loudspeaker having a convex mobile membrane, and a member surrounding the mobile membrane and comprising an external surface bounded by an internal edge (Γ') situated facing the mobile membrane, which comprises a peripheral edge (Γ) situated facing the internal edge of the member and forming a closed loop. The mobile membrane and the member have a suitable shape such that, over a continuous portion (Γ") of the peripheral edge (Γ) representing at least 25% of the
(Continued)

length of the peripheral edge, for any first point (M) on the continuous portion and any second point (M') situated on the internal edge at a location such that the distance between the first point (M) and second point (M') is minimal, the mobile membrane has, at the first point, a first tangent plane, essentially coincident with a second tangent plane at the second point.

16 Claims, 5 Drawing Sheets

(51) Int. Cl.

| | |
|---|---|
| ***H04R 1/28*** | (2006.01) |
| ***H04R 7/12*** | (2006.01) |
| ***H04R 5/02*** | (2006.01) |

(56) References Cited

FOREIGN PATENT DOCUMENTS

| | | | |
|---|---|---|---|
| FR | 2895201 | A1 | 6/2007 |
| WO | 08038021 | A1 | 4/2008 |

OTHER PUBLICATIONS

Preliminary Search Report for FR Application 1360616 dated Jul. 15, 2014.
Office Action for EP App No. 14783637.3, dated Nov. 29, 2018, 10 pages (with Machine Translation).

* cited by examiner

LOUDSPEAKER ENCLOSURE WITH AT LEAST ONE LOUDSPEAKER WITH A CONVEX MOBILE MEMBRANE EXHIBITING CONTINUITY OF SHAPE WITH AN ADJACENT MEMBER

CROSS-REFERENCE TO RELATED APPLICATIONS

This application is a U.S. National Phase application of PCT/EP2014/071842, filed on Oct. 13, 2014, claiming the benefit of FR Application No. 13 60616, filed Oct. 30, 2013, both of which are incorporated herein by reference in their entireties.

The present invention relates to a loudspeaker enclosure, of the type including:

at least one loudspeaker having a convex mobile membrane, the convex side being turned toward the outside of the enclosure, and a member surrounding the mobile membrane and including an outer surface bounded by an inner edge situated facing the mobile membrane, the mobile membrane including a peripheral edge situated opposite the inner edge of the member and forming a closed loop.

In order to preserve a good tone quality and spatial coherence favoring the obtainment of a wide and deep stereophonic image, a loudspeaker enclosure must have an amplitude and phase response that are as linear as possible for the span of audible frequencies, favoring the direction of the listening zone over its entire span in terms of width and height.

Traditional loudspeaker enclosures have a noticeable limitation in obtaining a spatially coherent sound, namely the interference phenomena between the acoustic radiation of loudspeakers making up primary acoustic sources, and the acoustic radiation of secondary acoustic sources created by diffraction phenomena.

The invention aims to propose a loudspeaker enclosure better limiting diffraction phenomena.

To that end, the invention relates to a loudspeaker enclosure of the aforementioned type, wherein the mobile membrane and the member have a shape adapted so that, over a continuous portion of the peripheral edge representing at least 25%, preferably at least 50%, still more preferably at least 90%, of the length of the peripheral edge, for any first point of the continuous portion and any second point situated on the inner edge in a location such that the distance between the first point and the second point is minimal, the mobile membrane has, at the first point, a first tangent plane, and the outer surface of the member has, at the second point, a second tangent plane, the first tangent plane and the second tangent plane being substantially coincident with one another.

According to specific embodiments, the acoustic enclosure includes one or more of the following features:

the outer surface of the member is configured such that, for any third point situated on the outer surface of the member at a distance from the continuous portion of less than or equal to $1/100^{th}$ of the perimeter of the mobile membrane, preferably less than or equal to $1/30^{th}$, and still more preferably less than or equal to $1/10^{th}$ of the perimeter of the mobile membrane, any planar arc belonging to the outer surface and passing through the third point has, at the third point, a curve radius greater than or equal to $1/100^{th}$ of the perimeter of the mobile membrane, preferably greater than or equal to $1/30^{th}$ of the perimeter of the mobile membrane, and still more preferably greater than or equal to $1/10^{th}$ of the perimeter of the mobile membrane;

the loudspeaker enclosure is intended to be pressed against a planar surface, and the member defines a peripheral edge and has a shape adapted so that, over a continuous portion of the peripheral edge representing at least 25%, preferably at least 50%, still more preferably at least 90%, of the length of the peripheral edge, for any point of the continuous portion, the outer surface of the member has, at said point, a third tangent plane, and so that the third tangent plane and the planar surface are substantially coincident with one another;

the member is an at least partially spherical box in a spherical zone; the loudspeaker enclosure includes a plurality of loudspeakers having mobile membranes, the loudspeakers being substantially identical and installed in a wall of the box; and the mobile membranes are in the form of a solid spherical cap with the same curvature as the curvature of the spherical zone of the box, the mobile membranes substantially extending the spherical zone of the box to form, in the idle position of the mobile membranes, a substantially continuous spherical surface;

the loudspeakers have stationary parts secured together rigidly, the loudspeakers being distributed angularly around a distribution axis so as to successively form angles between them substantially equal to 360° divided by N, N being the number of loudspeakers;

the spherical zone of the box and the surface of the mobile membranes define a spherical surface with an expanse greater than the surface of revolution created by rotation of a mobile membrane of a loudspeaker over at least 180° around an axis substantially perpendicular to the distribution axis;

an annular interval separates the periphery of the mobile membrane of each loudspeaker and the box, and the width of this interval measured radially is less than $1/100^{th}$ of the circumference of the mobile membranes;

the diameter of the circle defined by each mobile membrane is greater than half the diameter of the spherical zone of the box;

the maximum axial travel of the mobile membrane of each loudspeaker of said plurality is greater than $1/50^{th}$ of the diameter of the spherical zone of the box;

the stationary parts of the loudspeakers of said plurality are rigidly connected to the box;

the spherical zone, in which the loudspeakers of said plurality are found, is extended by a protuberance outwardly giving the box a generally oblong shape;

said plurality of loudspeakers comprises two loudspeakers;

the loudspeaker enclosure further comprises at least one first other loudspeaker positioned through the box and oriented along an axis substantially perpendicular to the distribution axis, the first other loudspeaker including a convex membrane fitted into a sphere with the same curvature as the curvature of the spherical zone of the box and substantially extending the spherical zone of the box to form, in the idle position of the convex membrane, a substantially continuous spherical surface;

the loudspeaker enclosure further comprises a second other loudspeaker positioned at the center of the first other loudspeaker and coaxial with the first other loudspeaker;

the mobile membranes are made from metal.

The invention will be better understood upon reading the following description, provided solely as an example and done in reference to the drawings, in which.

A loudspeaker enclosure 10 according to the invention is described in reference to FIGS. 1 to 5.

The enclosure 10 comprises at least one first loudspeaker 30A having a first convex mobile membrane 32A, the convex side being turned toward the outside of the enclosure, and a member 12 surrounding the first mobile membrane 32A and including an outer surface 12A bounded by an inner edge Γ' situated across from the mobile membrane 32A.

The member 12 is advantageously a box, as in the illustrated example, or a second loudspeaker (not shown) surrounding the first loudspeaker 30A, or a grate (not shown) covering this second adjacent loudspeaker.

The first mobile membrane 32A includes a peripheral edge Γ situated across from the member 12 and forming a closed loop.

Figure 4:
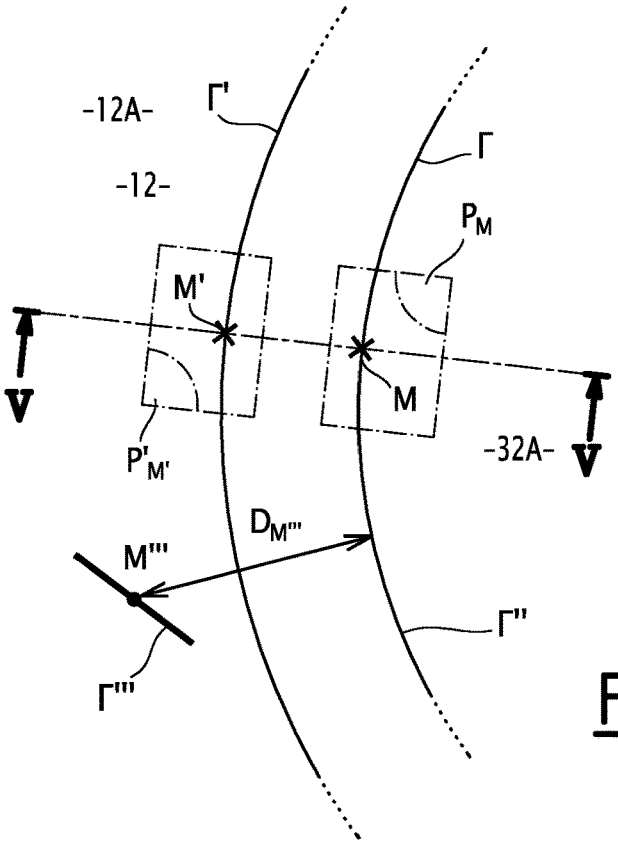
FIG. 4 is a detailed view of the interval separating the mobile membrane of the loudspeaker and the member surrounding the loudspeaker from the enclosure shown in FIGS. 1 to 3, the view being done in a direction substantially perpendicular to the mobile membrane.
Figure 5:
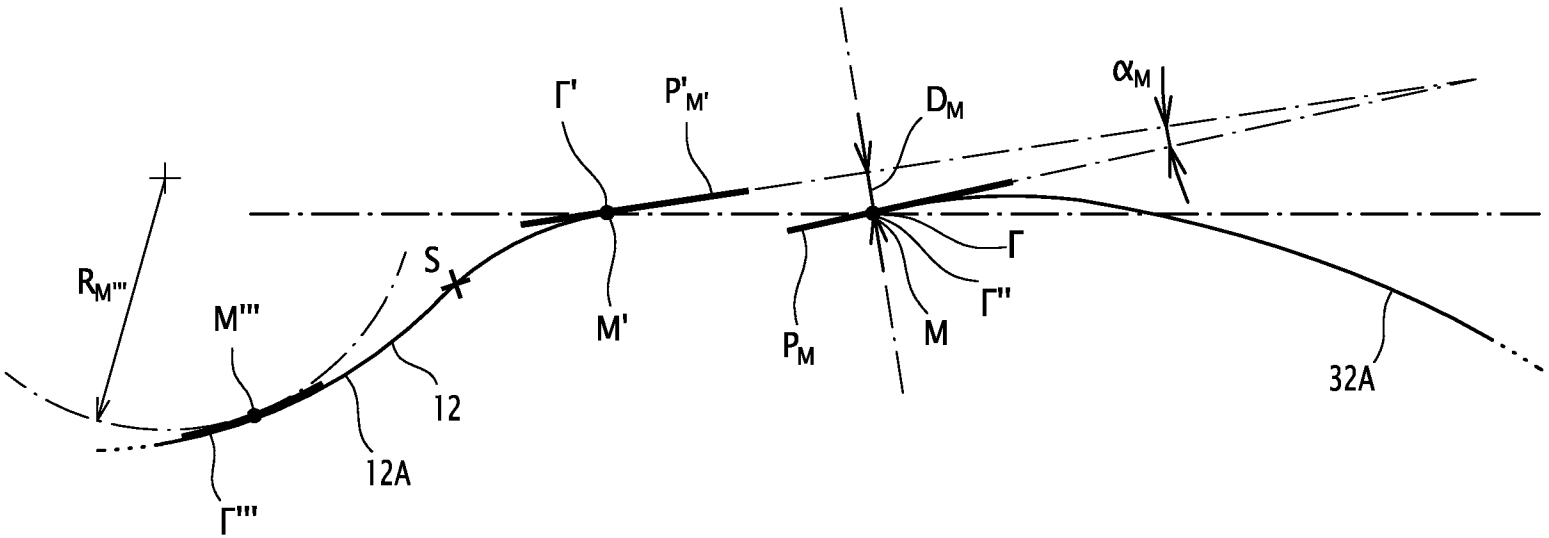
FIG. 5 is a detailed view of the interval shown in FIG. 4, the view being done in a direction substantially parallel to the interval.

As shown in FIGS. 4 and 5, the first mobile membrane 32A and the member 12 have a shape adapted so that, over a continuous portion Γ" of the peripheral edge Γ representing at least 25%, preferably at least 50%, still more preferably at least 90%, of the length of the peripheral edge Γ, for any first point M of the continuous portion Γ" and any second point M' situated on the inner edge Γ' at a location such that the distance between the first point M and the second point M' is minimal, the first mobile membrane 32A has, at the first point M, a first tangent plane $P_M$, and the outer surface 12A of the member 12 has, at the second point M', a second tangent plane $P'_M$.

The first tangent plane $P_M$ and the second tangent plane $P'_M$ are substantially coincident with one another.

"Substantially coincident" means that the first tangent plane $P_M$ and the second tangent plane $P'_M$ do not substantially differ from one another to the human eye. For example:

on the one hand, the first point M is situated at a distance $D_M$ from the second tangent plane $P'_M$, smaller than $1/100^{th}$ of the perimeter of the first mobile membrane 32A, preferably than $1/200^{th}$ of the perimeter of the mobile membrane 32A, and still more preferably than $1/400^{th}$ of the perimeter of the mobile membrane 32A. For example, for a mobile membrane whereof the perimeter forms a circle of 160 mm in diameter and 500 mm in perimeter, the first point M is situated at a distance $P_M$ from the second tangent plane $P'_M$, smaller than 5 mm, preferably smaller than 2.5 mm, still more preferably smaller than 1.25 mm, and on the other hand, the first tangent plane $P_M$ and the second tangent plane $P'_M$ form an angle $\alpha_m$ between them smaller than 10°, preferably smaller than 5°.

The outer surface 12A of the member 12 is configured so that, for any third point M"' (FIGS. 4 and 5) situated on the outer surface 12A of the member 12 at a distance $D_{M'''}$ from the continuous portion Γ" smaller than or equal to $1/100^{th}$ of the perimeter of the mobile membrane, preferably than $1/30^{th}$ of the perimeter of the mobile membrane, and still more preferably than $1/10^{th}$ of the perimeter of the mobile membrane, any planar arc Γ"' belonging to the outer surface 12A and passing through the third point M"' has, at the third point a curve radius $R_{M'''}$ greater than or equal to $1/100^{th}$ of the perimeter of the mobile membrane, preferably greater than or equal to $1/30^{th}$ of the perimeter of the mobile membrane, and still more preferably greater than or equal to $1/10^{th}$ of the perimeter of the mobile membrane.

Figure 1:
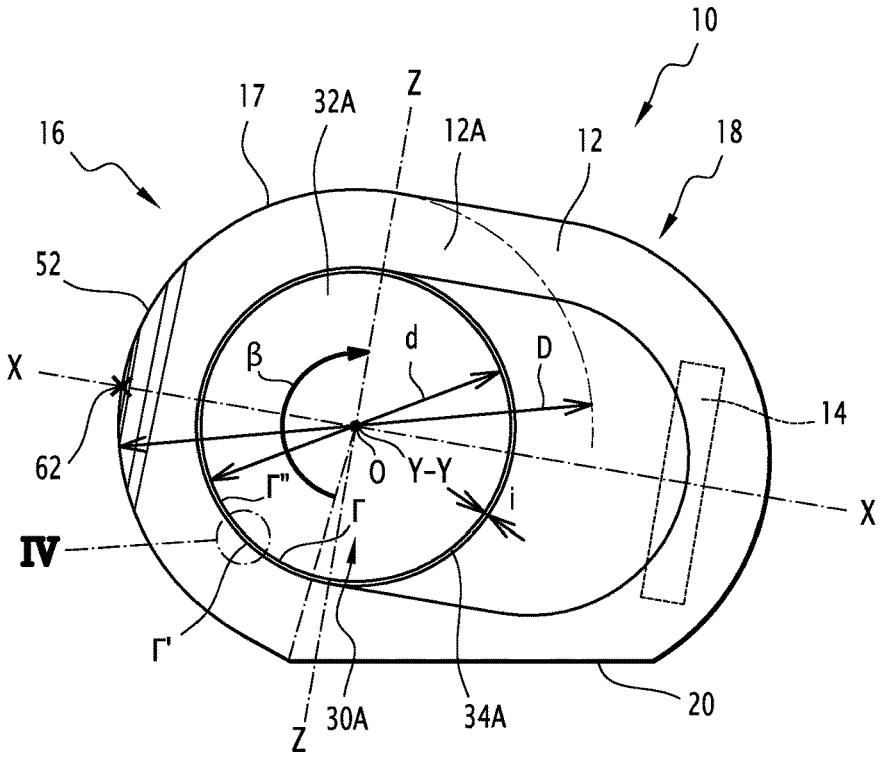
FIG. 1 is an elevation side view of a loudspeaker enclosure according to the invention.
Figure 2:
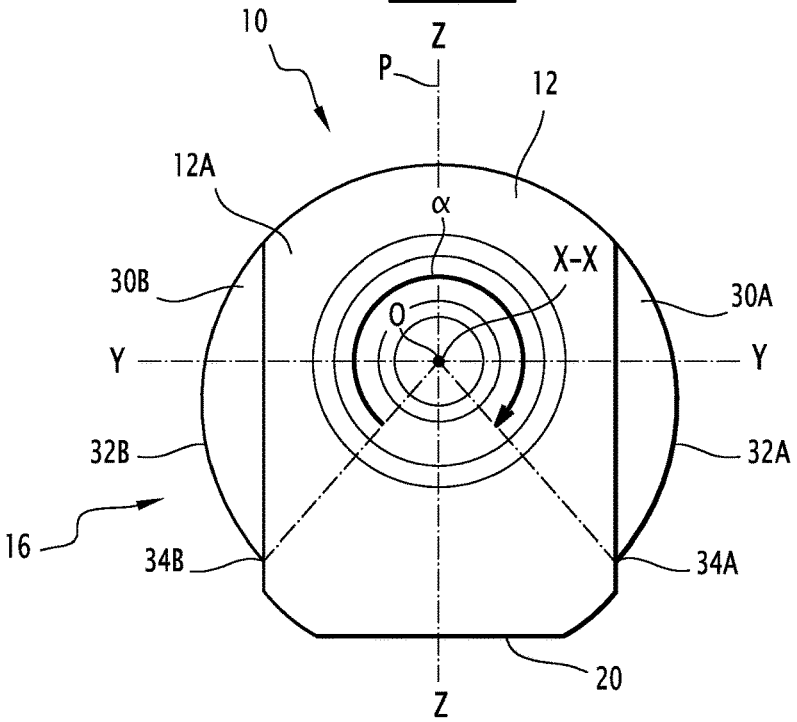
FIG. 2 is a front view of the enclosure shown in FIG. 1.
Figure 3:
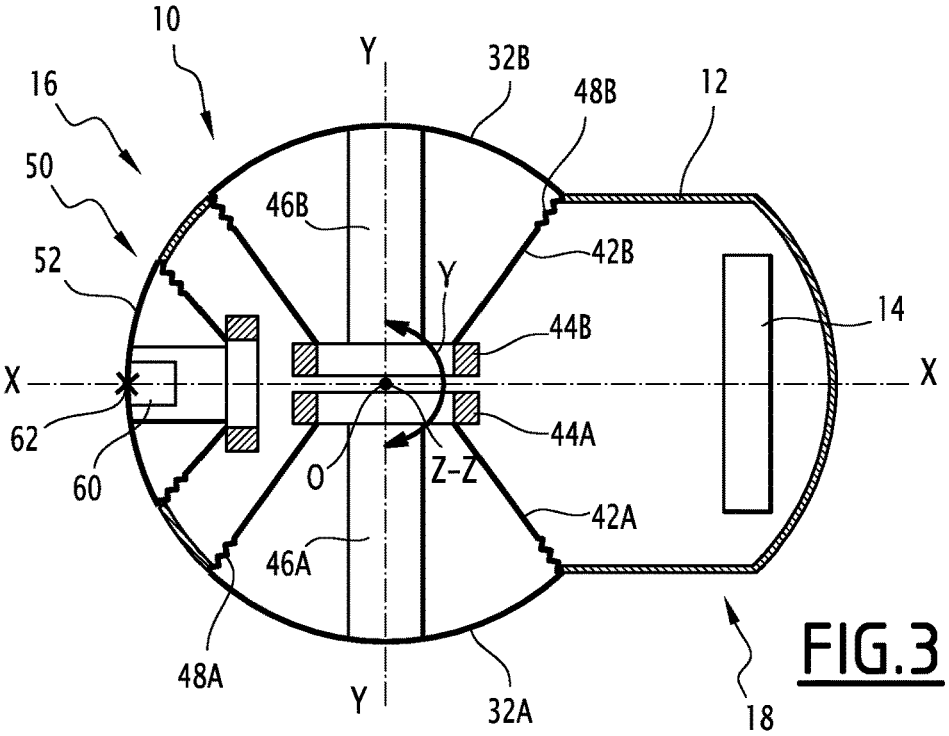
FIG. 3 is a diagrammatic sectional top view of the enclosure shown in FIGS. 1 and 2.

In the example illustrated in FIGS. 1 to 3, the enclosure 10 is an active loudspeaker enclosure, i.e., including a set of loudspeakers positioned in the box 12. The enclosure 10 also includes, inside the box 12, an amplifier 14 specific to each loudspeaker. This amplifier is connected to an excitation source, such as an audio reader.

The enclosure 10 outwardly has a generally oblong shape with axis X-X, more specifically with a lancet shape with a front end 16 having a spherical shape. The front end 16 outwardly forms a spherical zone 17 whereof the center O is positioned on the axis X-X.

The spherical zone 17 is extended toward the rear by a protuberance 18 in which the amplifier 14 is housed.

Over its length, the body 12 has a planar shape in the lower part to form a foot 20 making it possible to set the enclosure in a stable position on a horizontal surface. The enclosure 10 symmetrical around a plane perpendicular to the surface of the foot 20 and passing through the axis X-X.

In the plane of FIG. 1, i.e., seen from the side, the spherical zone 17 extends over an angular expanse β substantially equal to 180°, and more generally advantageously greater than 150°.

In the plane of FIG. 2, i.e., seen from the end, the spherical zone 17 extends angularly over an angle α of 270°, and more generally preferably greater than 225°.

The enclosure 10 includes a plurality of loudspeakers 30A, 30B, which are for example woofers. Each loudspeaker of said plurality respectively comprises a mobile membrane 32A, 32B.

Woofers refer to loudspeakers suitable for diffusing acoustic waves with frequencies lower than 1000 Hz, preferably lower than 500 Hz, still more preferably lower than 150 Hz.

The enclosure 10 for example includes two first woofers 30A, 30B positioned symmetrically relative to the axis X-X and emerging in the spherical space 17. The two loudspeakers are positioned along the same axis Y-Y extending perpendicular to the axis X-X of the enclosure. The axis Y-Y is parallel to the bearing surface 20. The axes X-X and Y-Y are secant to the point O forming the center of the spherical region 17.

The loudspeakers 30A, 30B form an angle equal to 360° divided by two, therefore 180°, between them around a distribution axis Z-Z substantially perpendicular to the axis X-X and substantially perpendicular to the axis Y-Y.

These two loudspeakers have a membrane 32A, 32B in the form of a solid spherical cap with the same curvature as the spherical zone 17. The spherical membrane extends the spherical zone 17 substantially continuously, when the membrane 32A, 32B is idle.

Thus, preferably, the spherical zone 17 of the box and the surface of the spherical membranes 32A, 32B of the two woofers 30A, 30B define a spherical surface with an expanse at least equal to the surface of revolution created by rotation of a spherical membrane 32A, 32B of a woofer 30A, 30B over at least 180° around an axis X-X perpendicular to the axis Y-Y of the two spherical membranes 32A, 32B.

An annular peripheral interval 34A, 34B separates the membrane 32A, 32B of the speakers from the spherical zone 17. Preferably, the width i of this annular interval between the membrane of each woofer and the box, measured radially in the plane of the circumference of the membrane of the loudspeakers, is smaller than $1/100^{th}$ of the perimeter of the membrane of the loudspeaker. Preferably, it is smaller than $1/200^{th}$, and still more preferably smaller than $1/400^{th}$. Thus, for example for a loudspeaker with a circumference of 500 mm, this width is smaller than 5 mm, preferably smaller than 2.5 mm, and still more preferably smaller than 1.25 mm.

Advantageously, the diameter d of the circle defined by the spherical cap forming the membrane 32A, 32B of each woofer is larger than half of the diameter denoted D of the spherical zone 17 of the box. Preferably, it is greater than ⅔ of this diameter D, and still more preferably greater than ¾ of this diameter ¾.

For example, for a diameter d of the woofer of 160 mm, the diameter D of the spherical zone is then comprised between 320 mm and 220 mm.

The two loudspeakers 30A and 30B are identical and are mounted back-to-back. Thus, the stationary parts of the two loudspeakers form chassis 42A, 42B that are rigidly connected to one another. Furthermore, these chassis are secured using any appropriate means to the box 12.

Said plurality of loudspeakers 30A, 30B is advantageously positioned such that the reaction forces of the mobile membrane 32A, 32B on the chassis 42A, 42B have a zero sum.

FIG. 3 diagrammatically illustrates the stationary magnets 44A, 44B of the two woofers 30A, 30B. In each loudspeaker, a piston 46A, 46B on which a coil is arranged is mounted translatably relative to each magnet 44A, 44B. At its end, this piston bears the spherical membrane 32A, 32B.

Advantageously, the membrane is made from metal, in particular aluminum, magnesium, titanium. Thus, the membrane is not very deformable. It is connected to the chassis of the loudspeaker by a sealing device, for example a bellows 48A, 48B. According to alternatives, the membrane is made from plastic, composite material, paper, etc.

The two woofers 30A, 30B are designed such that the maximum angular travel along the axis Y-Y of the membrane of each woofer is greater than $1/50^{th}$ of the diameter D of the spherical zone 17 of the box. Advantageously, this travel is greater than $1/20^{th}$ of the diameter D of the spherical zone 17, and still more preferably greater than $1/5^{th}$ of the diameter D of the spherical zone 17.

The enclosure 10 further includes a loudspeaker 50, for example a mid-range loudspeaker, positioned along the axis X-X and emerging in the spherical zone 17. The loudspeaker 50 has a membrane 52 forming an incomplete spherical cap open-worked at its apex. This spherical membrane 52 has a radius equal to the curve radius of the spherical zone 17 and extends in the extension of that spherical region to form a substantially continuous spherical surface when the membrane 52 is idle.

A mid-range loudspeaker refers to loudspeaker suitable for diffusing acoustic waves at frequencies from 300 Hz to 3 kHz, or from 150 Hz to 6 kHz.

Preferably, a tweeter 60 is positioned axially at the center of the loudspeaker 50.

A tweeter refers to a loudspeaker suitable for diffusing acoustic waves with frequencies from 3 kHz to 20 kHz, or from 1 kHz to 40 kHz.

The tweeter also has a spherical membrane with a radius equal to the radius of the spherical zone 17 and fits in the enclosure of the spherical zone 17.

Owing to the features of the enclosure 10 described above, the convex mobile membranes of the loudspeakers marry the shape of the box on either side of the intervals separating the mobile membranes and the box. Thus, the diffraction phenomena are greatly reduced.

Furthermore, one can see that with such an enclosure, the woofers placed back-to-back have identical movements of their membrane, the chassis of the two loudspeakers remaining immobile relative to the box, the reaction forces applied by the membranes on the chassis canceling each other out.

Figure 6:
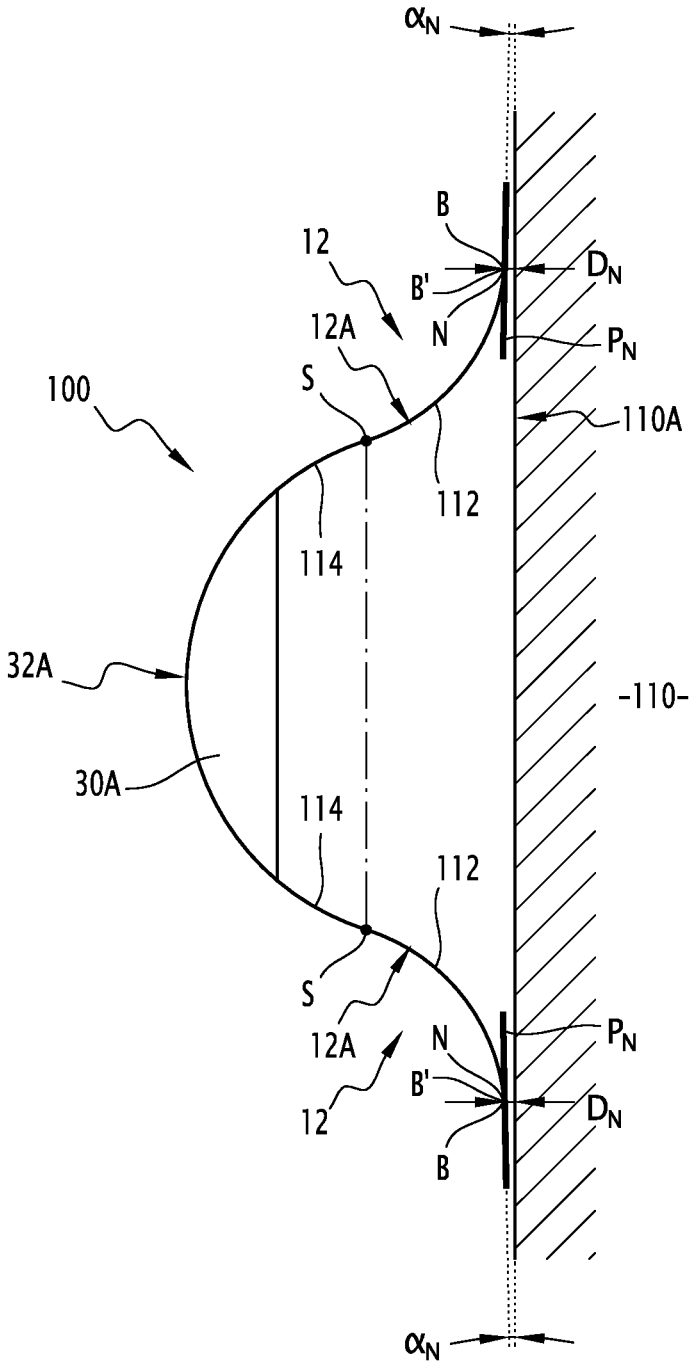
FIG. 6 is a profile view of an enclosure according to one particular embodiment of the invention.
Figure 7:
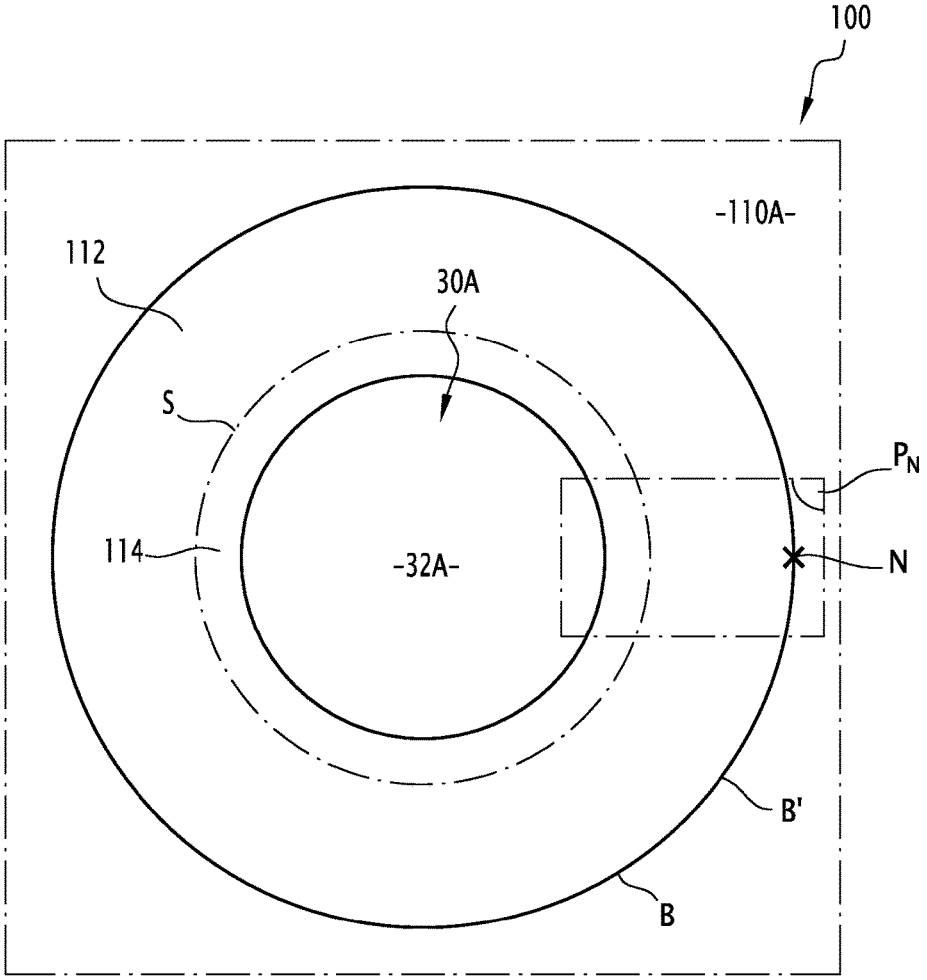
FIG. 7 is a front view of the enclosure shown in FIG. 6.

In reference to FIG. 6, a loudspeaker enclosure 110 is described representing one particular embodiment of the invention. The enclosure 100 is similar to the enclosure 10 shown in FIGS. 1 to 5. As with the enclosure 10, the enclosure 100 comprises a loudspeaker 30A having a first convex mobile membrane 32A, the convex side being turned toward the outside of the enclosure, and a member 12 surrounding the first mobile membrane 32A and including an outer surface 12A. The member 12 is for example a box.

Only the differences with respect to the enclosure 10 shown in FIGS. 1 to 5 will be described in detail below.

The enclosure 100 is pressed against a wall 110 defining a planar surface 110A.

The wall 110 is for example a vertical wall, or the top of a table (not shown).

The member 12 comprises a radially distal peripheral portion 112 relative to the mobile membrane 32A, and a radially proximal inner portion 114 relative to the mobile membrane 32A.

The peripheral portion 112 is for example convex. The peripheral portion 112 defines a closed peripheral edge B. The peripheral portion 112 surrounds the inner portion 114.

The inner portion 114 is for example concave.

Between the inner portion 114 and the peripheral portion 112 is an inflection zone S, which is a closed line in the illustrated example.

The member 12 has a shape adapted so that, over a continuous portion B' of the peripheral edge B representing at least 25%, preferably at least 50%, still more preferably with 90%, of the length of the peripheral edge B, for any point N of the continuous portion B', the outer surface 12A of the member 12 has, at the point N, a third tangent plane $P_N$.

The third tangent plane $P_N$ and the planar surface 110A are substantially coincident.

"Substantially coincident" means that the third tangent plane $P_N$ and the planar surface 110A do not substantially differ from one another to the human eye. For example:

on the one hand, the point N is situated at a distance $D_N$ from the third tangent plane $P_N$ smaller than $1/100^{th}$ of the perimeter of the first mobile membrane 32A, preferably than $1/200^{th}$ of the perimeter of the mobile membrane 32A, and still more preferably than $1/400^{th}$. For example, the point N is situated at a distance $D_N$ from the planar surface 110A smaller than 5 mm, preferably smaller than 3 mm, still more preferably smaller than 1 mm, and on the other hand, the third tangent plane $P_N$ and the planar surface 110A form an angle $\alpha_N$ between them smaller than 10°, preferably smaller than 5°.

The enclosure 100 makes it possible to minimize the diffraction and reflection related to the presence of the wall 110 in the immediate vicinity of the enclosure.

The invention claimed is:

1. A loudspeaker enclosure (10; 100), including:

at least one loudspeaker having a convex mobile membrane, the convex side being turned toward the outside of the enclosure, and a member surrounding the mobile membrane and including an outer surface bounded by an inner edge (Γ') situated facing the mobile membrane, the mobile membrane including a peripheral edge (Γ) situated opposite the inner edge (Γ') of the member and forming a closed loop, wherein the mobile membrane and the member have a shape adapted so that, over a continuous portion (Γ") of the peripheral edge (Γ) representing at least 25% of the length of the peripheral edge (Γ), for any first point (M) of the continuous portion (Γ") and any second point (M') situated on the inner edge (Γ') at a location such that the distance between the first point (M) and the second point (M') is minimal, the mobile membrane has, at the first point (M), a first tangent plane ($P_M$), and the outer surface of the member has, at the second point (M'), a second tangent plane ($P'_{M'}$), the first tangent plane (PM) and the second tangent plane ($P'_{M'}$) being substantially coincident with one another, wherein:

the member is a box that is at least partially spherical in a spherical zone, the loudspeaker enclosure includes a plurality of loudspeakers having mobile membranes, the loudspeakers being substantially identical and installed in a wall of the box, and the mobile membranes are in the form of a solid spherical cap with the same curvature as the curvature of the spherical zone of the box, the mobile membranes substantially extending the spherical zone of the box to form, in the idle position of the mobile membranes, a substantially continuous spherical surface.

2. The loudspeaker enclosure according to claim 1, characterized in that the outer surface of the member is configured so that, for any third point (M"') situated on the outer surface of the member at a distance ($D_{M'''}$) from the continuous portion (Γ") smaller than or equal to 1/100th of the perimeter of the mobile membrane, preferably smaller than or equal to 1/30th of the perimeter of the mobile membrane (32A), and still more preferably smaller than or equal to 1/10th of the perimeter of the mobile membrane (32A), any planar arc (Γ"') belonging to the outer surface and passing through the third point (M"') has, at the third point (M"'), a curve radius ($R_{M'''}$) greater than or equal to 1/100th of the perimeter of the mobile membrane.

3. The loudspeaker enclosure according to claim 1, wherein the loudspeaker is adapted and configured to be pressed against a planar surface, and in that the member defines a peripheral edge (B) and has a shape adapted so that, over a continuous portion (B') of the peripheral edge (B) representing at least 25% of the length of the peripheral edge (B), for any point (N) of the continuous portion (B'), the outer surface of the member has, at said point (N), a third tangent plane ($P_N$), and so that the third tangent plane ($P_N$) and the planar surface are substantially coincident with one another.

4. The loudspeaker enclosure according to claim 1, wherein the loudspeakers have stationary parts secured together rigidly, the loudspeakers being distributed angularly around a distribution axis (Z-Z) so as to successively form angles (γ) between them substantially equal to 360° divided by N, N being the number of loudspeakers.

5. The loudspeaker enclosure according to claim 1, wherein the spherical zone of the box and the surface of the mobile membranes define a spherical surface with an expanse greater than the surface of revolution created by rotation of a mobile membrane of a loudspeaker over at least 180° around an axis (X-X) substantially perpendicular to the distribution axis (Z-Z).

6. The loudspeaker enclosure according to claim 1, wherein an annular interval separates the periphery of the mobile membrane of each loudspeaker and the box, and in that the width (i) of this interval measured radially is less than 1/100th of the circumference of the mobile membranes.

7. The loudspeaker enclosure according to claim 1, wherein the diameter (d) of the circle defined by each mobile membrane is greater than half the diameter (D) of the spherical zone of the box.

8. The loudspeaker enclosure according to claim 1, wherein the maximum axial travel of the mobile membrane of each loudspeaker of said plurality is greater than 1/50th of the diameter (D) of the spherical zone of the box.

9. The loudspeaker enclosure according to claim 1, wherein the stationary parts of the loudspeakers of said plurality are rigidly connected to the box.

10. The loudspeaker enclosure according to claim 1, wherein the spherical zone, in which the loudspeakers of said plurality are found, is extended by a protuberance outwardly giving the box a generally oblong shape.

11. The loudspeaker enclosure according to claim 1, wherein said plurality of loudspeakers comprises two loudspeakers.

12. The loudspeaker enclosure according claim 1, wherein it further comprises at least one first other loudspeaker positioned through the box and oriented along an axis (X-X) substantially perpendicular to the distribution axis (Z-Z), the first other loudspeaker including a convex membrane fitted into a sphere with the same curvature as the curvature of the spherical zone of the box and substantially extending the spherical zone of the box to form, in the idle position of the convex membrane, a substantially continuous spherical surface.

13. The loudspeaker enclosure according to claim 12, wherein it further comprises a second other loudspeaker positioned at the center of the first other loudspeaker and coaxial with the first other loudspeaker.

14. A loudspeaker enclosure, including:

at least one loudspeaker having a convex mobile membrane, the convex side being turned toward the outside of the enclosure, and a member surrounding the mobile membrane and including an outer surface bounded by an inner edge (Γ') situated facing the mobile membrane, the mobile membrane including a peripheral edge (Γ) situated opposite the inner edge (Γ') of the member and forming a closed loop, wherein the mobile membrane and the member have a shape adapted so that, over a continuous portion (Γ") of the peripheral edge (Γ) representing at least 25% of the length of the peripheral edge (Γ), for any first point (M) of the continuous portion (Γ") and any second point (M') situated on the inner edge (Γ') at a location such that the distance between the first point (M) and the second point (M') is minimal, the mobile membrane has, at the first point (M), a first tangent plane (PM), and the outer surface of the member has, at the second point (M'), a second tangent plane (P'M), the first tangent plane (PM) and the second tangent plane (P'M) being substantially coincident with one another, and wherein the member is a box.

15. The loudspeaker enclosure according to claim 14, wherein the box is at least partially spherical in a spherical zone.

16. The loudspeaker enclosure according to claim 15, wherein said mobile membrane is in the form of a solid spherical cap with the same curvature as the curvature of the spherical zone of the box, the mobile membranes substantially extending the spherical zone of the box to form, in the idle position of the mobile membranes, a substantially continuous spherical surface.

* * * * *